US010944222B2

(12) United States Patent
Kobayashi

(10) Patent No.: US 10,944,222 B2
(45) Date of Patent: Mar. 9, 2021

(54) ELECTRICAL CONNECTOR WITH TWO TYPES OF CONNECTOR TERMINALS AND A SPACER INSERTED INTO A HOUSING

(71) Applicant: Yazaki Corporation, Tokyo (JP)

(72) Inventor: Tooru Kobayashi, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/740,375

(22) Filed: Jan. 10, 2020

(65) Prior Publication Data

US 2020/0227871 A1 Jul. 16, 2020

(30) Foreign Application Priority Data

Jan. 16, 2019 (JP) ..... JP2019-005159

(51) Int. Cl.

| | |
|---|---|
| ***H01R 13/74*** | (2006.01) |
| ***H01R 13/627*** | (2006.01) |
| ***H01R 13/639*** | (2006.01) |
| *H01R 13/506* | (2006.01) |
| *H01R 13/424* | (2006.01) |
| *H01R 13/436* | (2006.01) |
| *H01R 13/422* | (2006.01) |

(52) U.S. Cl.

CPC ..... *H01R 13/743* (2013.01); *H01R 13/6272* (2013.01); *H01R 13/639* (2013.01); *H01R 13/424* (2013.01); *H01R 13/4223* (2013.01); *H01R 13/4361* (2013.01); *H01R 13/4362* (2013.01); *H01R 13/4365* (2013.01); *H01R 13/4368* (2013.01); *H01R 13/506* (2013.01); *H01R 13/627* (2013.01); *H01R 13/6271* (2013.01)

(58) Field of Classification Search

CPC ..... H01R 13/4223; H01R 13/4362; H01R 13/4365; H01R 13/6272; H01R 13/506; H01R 13/424; H01R 13/4361; H01R 13/4368; H01R 13/6271; H01R 13/627; H01R 13/743; H01R 12/639; H01R 13/639

USPC ..... 439/752, 595

See application file for complete search history.

(56) References Cited

U.S. PATENT DOCUMENTS

2010/0178791 A1* 7/2010 Komiyama ..... H01R 13/4361 439/347

2018/0248293 A1 8/2018 Ochiai

FOREIGN PATENT DOCUMENTS

JP 2008-235050 A 10/2008

JP 2018-120687 A 8/2018

* cited by examiner

*Primary Examiner* — Abdullah A Riyami

*Assistant Examiner* — Justin M Kratt

(74) *Attorney, Agent, or Firm* — Kenealy Vaidya LLP

(57) ABSTRACT

In a connector, a spacer includes lock parts and regulation parts. Each of the lock parts locks a first terminal in a first terminal receiving slot after the first terminal is inserted into a proper position in the first terminal receiving slot. Each of the regulation parts regulates deformation of a second lance toward a release position when the second lance is located in a lock position in which the second lance locks a second terminal in a second terminal receiving slot after the second terminal is inserted into a proper position in the second terminal receiving slot.

6 Claims, 14 Drawing Sheets

ELECTRICAL CONNECTOR WITH TWO TYPES OF CONNECTOR TERMINALS AND A SPACER INSERTED INTO A HOUSING

CROSS-REFERENCE TO RELATED APPLICATION(S)

The present application claims priority to and incorporates by reference the entire contents of Japanese Patent Application No. 2019-005159 filed in Japan on Jan. 16, 2019.

BACKGROUND OF THE INVENTION

1. Field of the Invention

The present invention relates to a connector.

2. Description of the Related Art

Conventional examples of a connector applied to a wire harness or the like in a vehicle include a connector disclosed in Japanese Patent Application Laid-open No. 2008-235050. The connector disclosed therein includes a plurality of terminals. In the connector, a plurality of terminal receiving slots provided in a housing have the respective terminals inserted therein. This connector includes lances and a retainer (spacer). The lance is provided on a wall surface of the terminal receiving slot so as to be elastically deformable. The retainer is attached to the housing by being moved in a direction (assembly direction) intersecting a terminal insertion direction in which the terminals are inserted into the housing. The retainer thus prevents the terminals from escaping.

In recent years, desired features of connectors for use in vehicles such as automobiles have been changed as electronic devices installed in vehicles have been increasingly advanced. Currently, such desired features include the capability of accommodating a large number of terminals of a variety of types and the capability of appropriately retaining these terminals regardless of how large the number of terminals may be.

SUMMARY OF THE INVENTION

The present invention has been made in view of the above situation and is directed to providing a connector capable of appropriately retaining terminals of a variety of types in a housing. In order to achieve the above mentioned object, a connector according to one aspect of the present invention includes a first terminal; a second terminal different from the first terminal; a housing that includes a first terminal receiving slot extending along a terminal insertion direction and configured to have the first terminal inserted therein, a second terminal receiving slot extending along the terminal insertion direction and configured to have the second terminal inserted therein, a lance provided on a wall surface of the second terminal receiving slot and being elastically deformable between a lock position and a release position, the lock position being a position in which the lance locks the second terminal in the second terminal receiving slot after the second terminal enters the second terminal receiving slot and is inserted into a proper position, the release position being a position retreated from the second terminal receiving slot, and an installation space part formed along an assembly direction intersecting the terminal insertion direction; and a spacer configured to be incorporated, during assembly, into the installation space part by being moved in the assembly direction, wherein the spacer includes a lock part configured to lock the first terminal in the first terminal receiving slot after the first terminal is inserted into a proper position in the first terminal receiving slot, and a regulation part configured to regulate deformation of the lance toward the release position when the lance is located in the lock position in which the lance locks the second terminal in the second terminal receiving slot after the second terminal is inserted into a proper position in the second terminal receiving slot.

According to another aspect of the present invention, in the connector, it is preferable that the first terminal has a first recess located between a front end portion thereof and a base end portion thereof in the terminal insertion direction and recessed from a circumferential surface of the front end portion, the lock part of the spacer is capable of interlocking with the first recess, when the spacer is moved to the installation space part with the first terminal inserted into the proper position, the first recess and the lock part interlock with each other, and the spacer is disposed in a normal position, and when the spacer is moved to the installation space part with the first terminal not inserted into the proper position, the first recess and the lock part do not interlock with each other, and the spacer is disposed in a position deviated from the normal position.

According to still another aspect of the present invention, in the connector, it is preferable that the second terminal has a second recess located between a front end portion thereof and a base end portion thereof in the terminal insertion direction and recessed from a circumferential surface of the front end portion, the lance is capable of interlocking with the second recess, when the spacer is moved to the installation space part with the second terminal inserted into the proper position, the second recess and the lance interlock with each other, and the spacer is disposed in a normal position, and when the spacer is moved to the installation space part with the second terminal not inserted into the proper position, the second recess and the lance do not interlock with each other, and the spacer is disposed in a position deviated from the normal position.

According to still another aspect of the present invention, in the connector, it is preferable that the second terminal includes upper second terminals positioned in an upper part in the assembly direction and lower second terminals positioned in a lower part in the assembly direction, the upper second terminals and the lower second terminals are aligned in a terminal alignment direction intersecting the terminal insertion direction and the assembly direction, each of the lower second terminals is arranged between adjacent two of the upper second terminals in the terminal alignment direction, the regulation part includes first regulation parts and second regulation parts, the first regulation parts being configured to regulate deformation of the lance that locks one of the upper second terminals in the second terminal receiving slot, the second regulation parts being configured to regulate deformation of the lance that locks one of the lower second terminals in the second terminal receiving slot, and the first regulation parts and the second regulation parts are alternately arranged in the terminal alignment direction.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

The following describes an embodiment of a connector according to the present invention with reference to the drawings. This embodiment is not intended to limit the invention.

Embodiment

Figure 1:
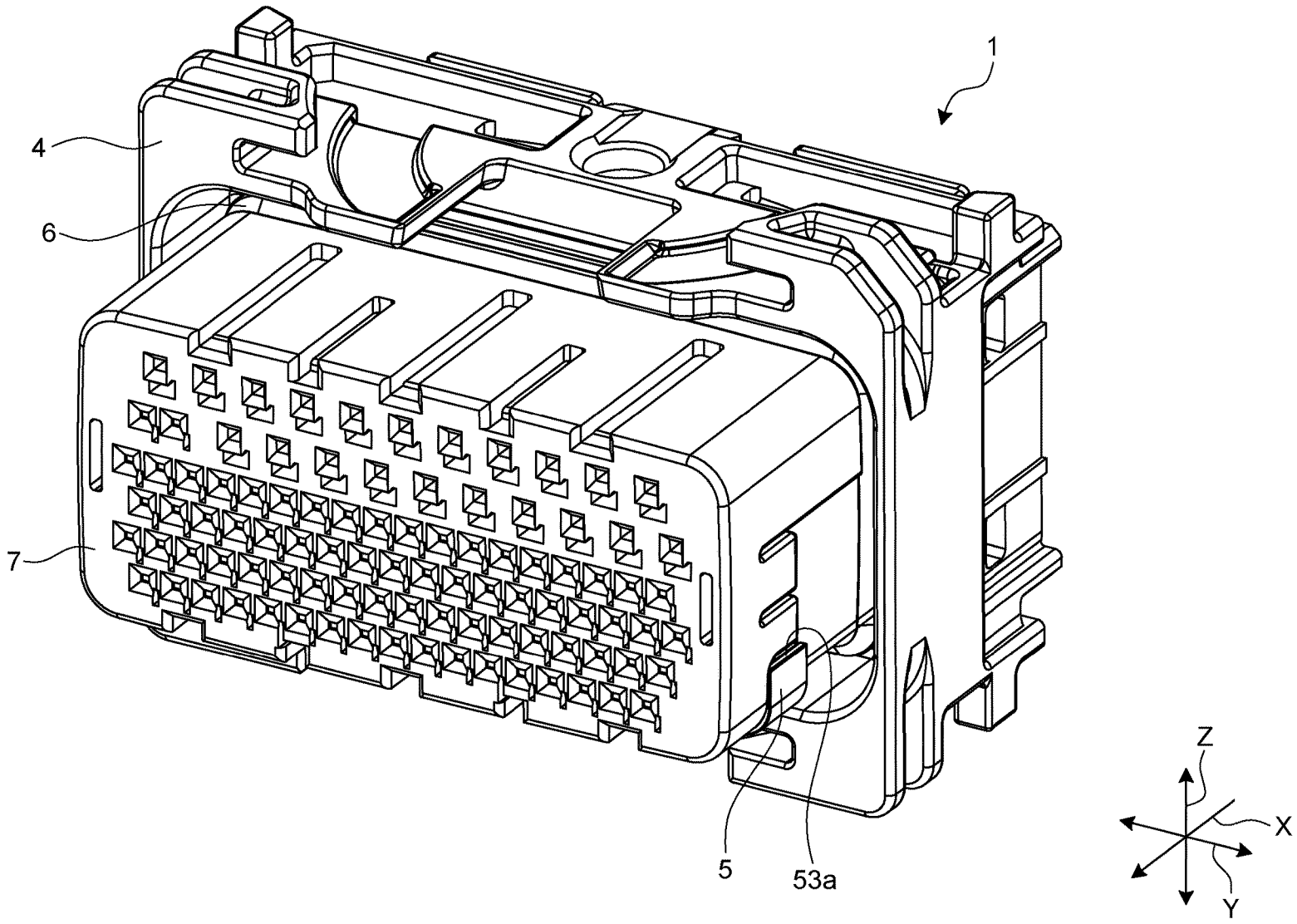
FIG. 1 is a perspective view of a connector according to an embodiment of the present invention.
Figure 2:
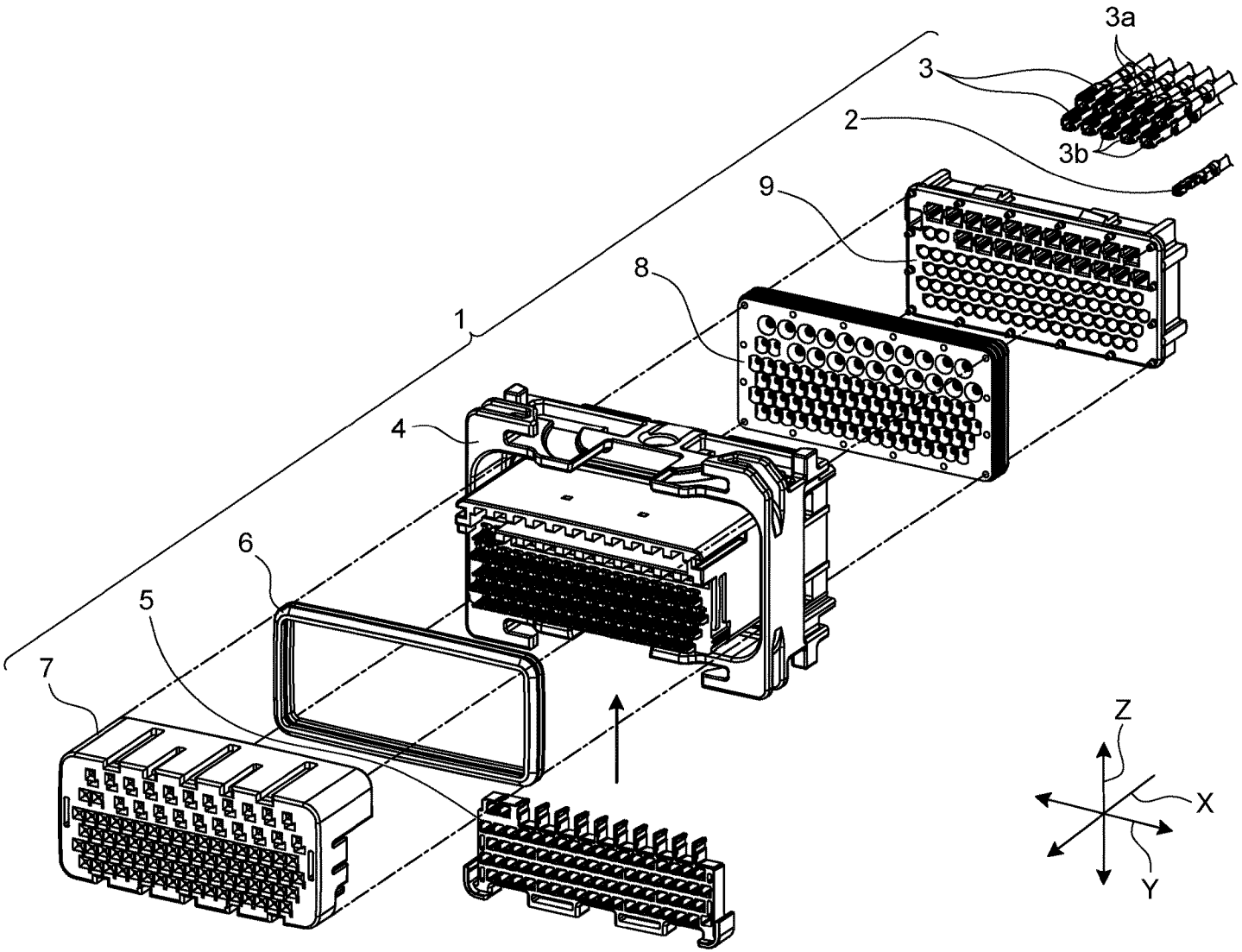
FIG. 2 is an explored perspective view of the connector.
Figure 3:
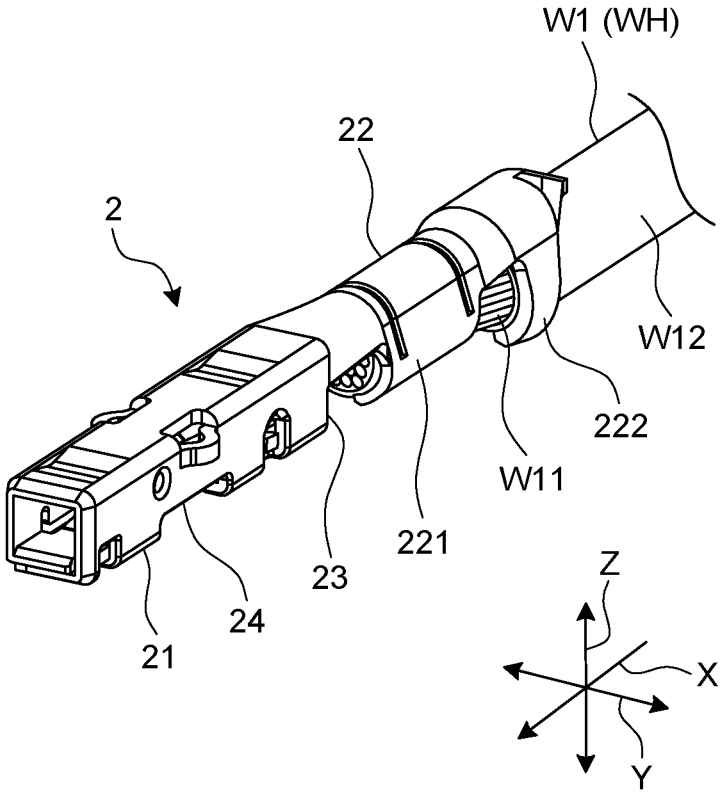
FIG. 3 is a perspective view of a first electrical wire included in the connector.
Figure 4:
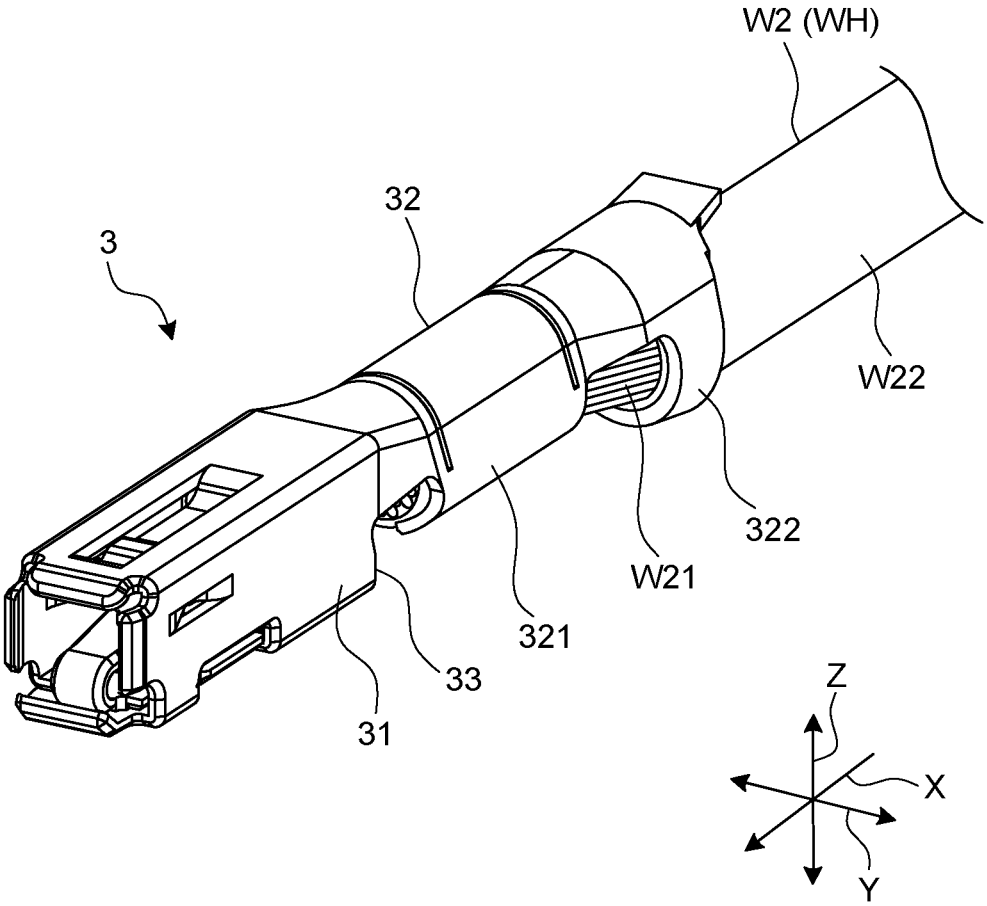
FIG. 4 is a perspective view of a second electrical wire included in the connector.
Figure 5:
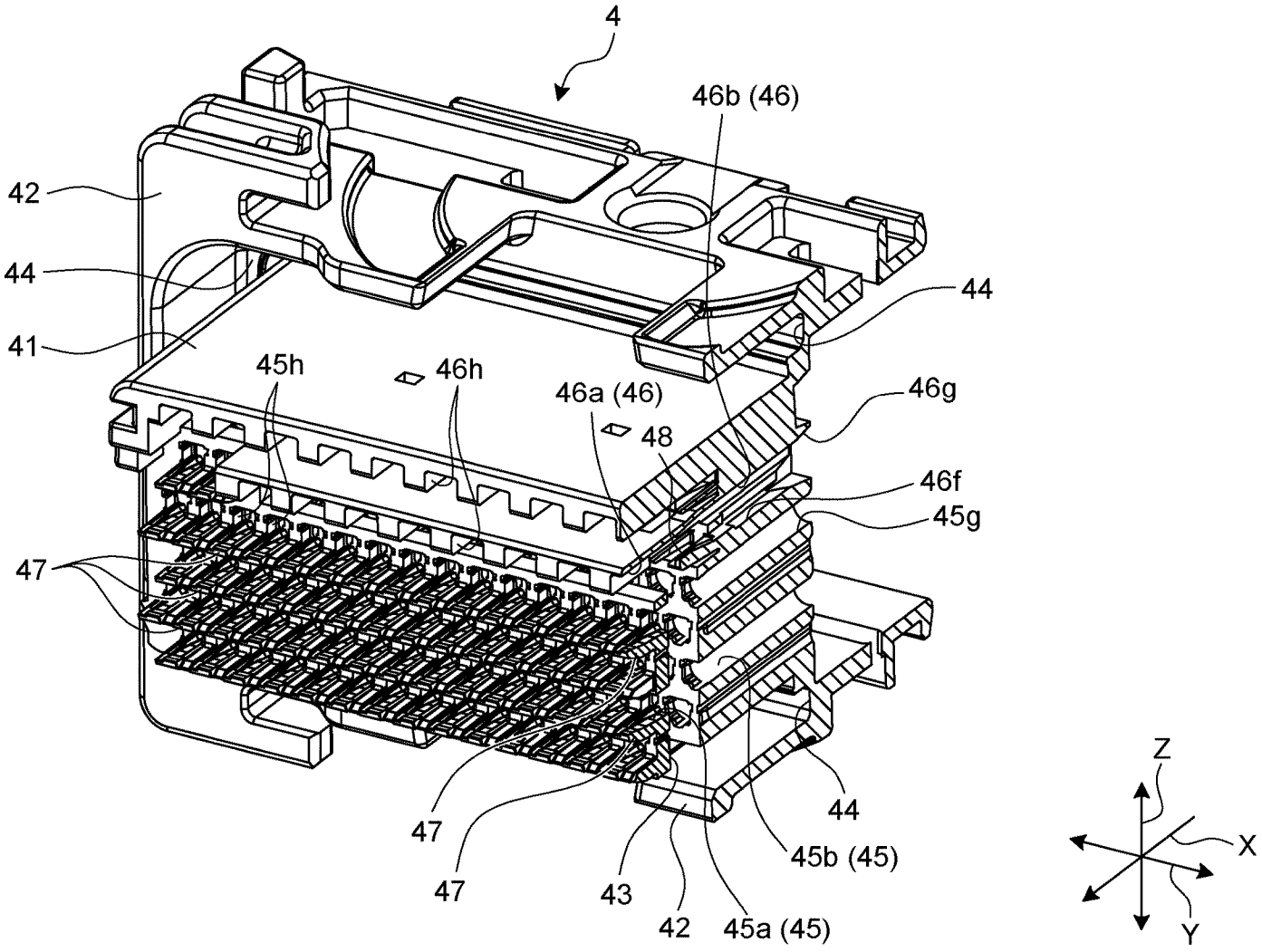
FIG. 5 is a partially cutaway perspective view of a housing included in the connector.
Figure 6:
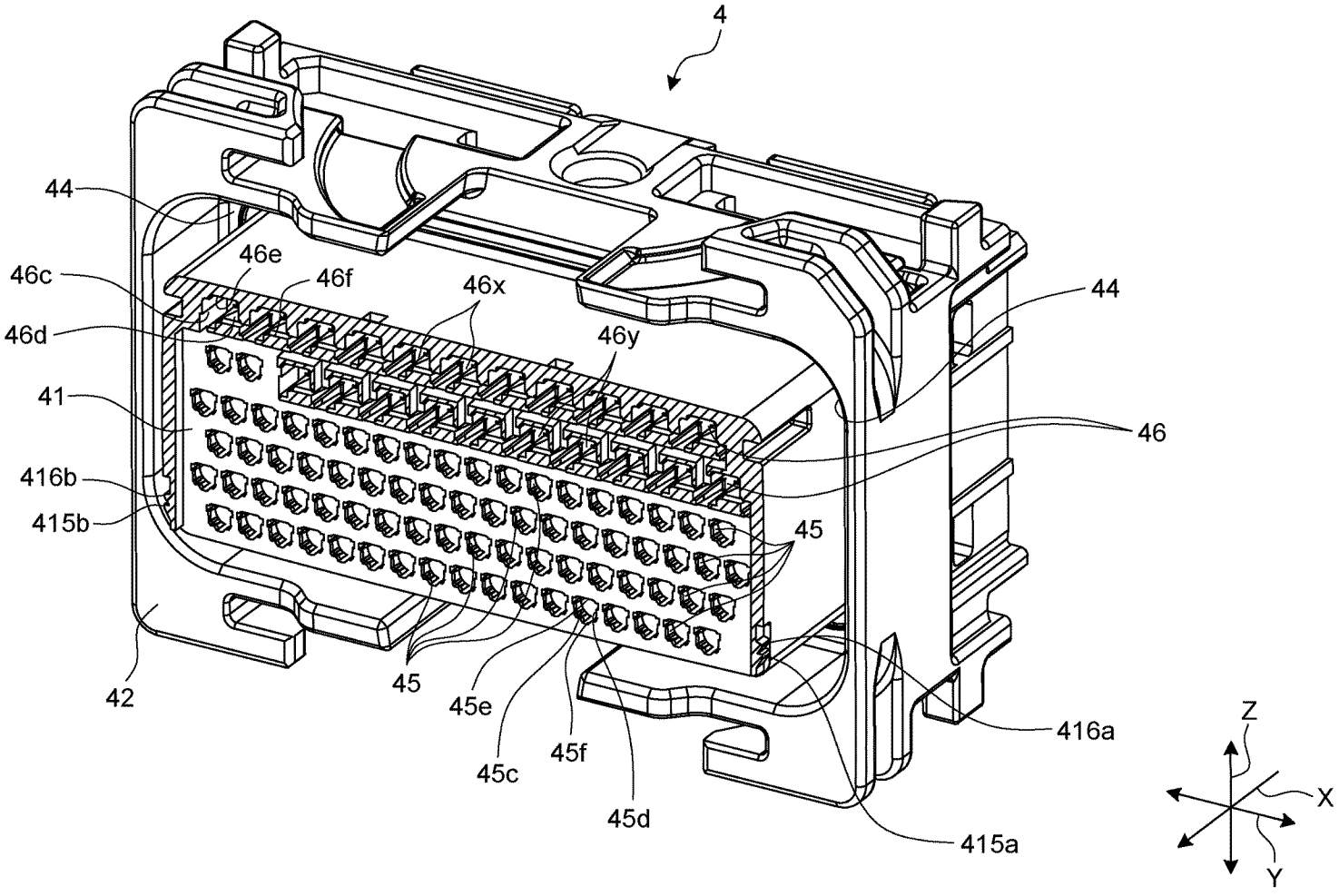
FIG. 6 is a partially cutaway perspective view of the housing.
Figure 7:
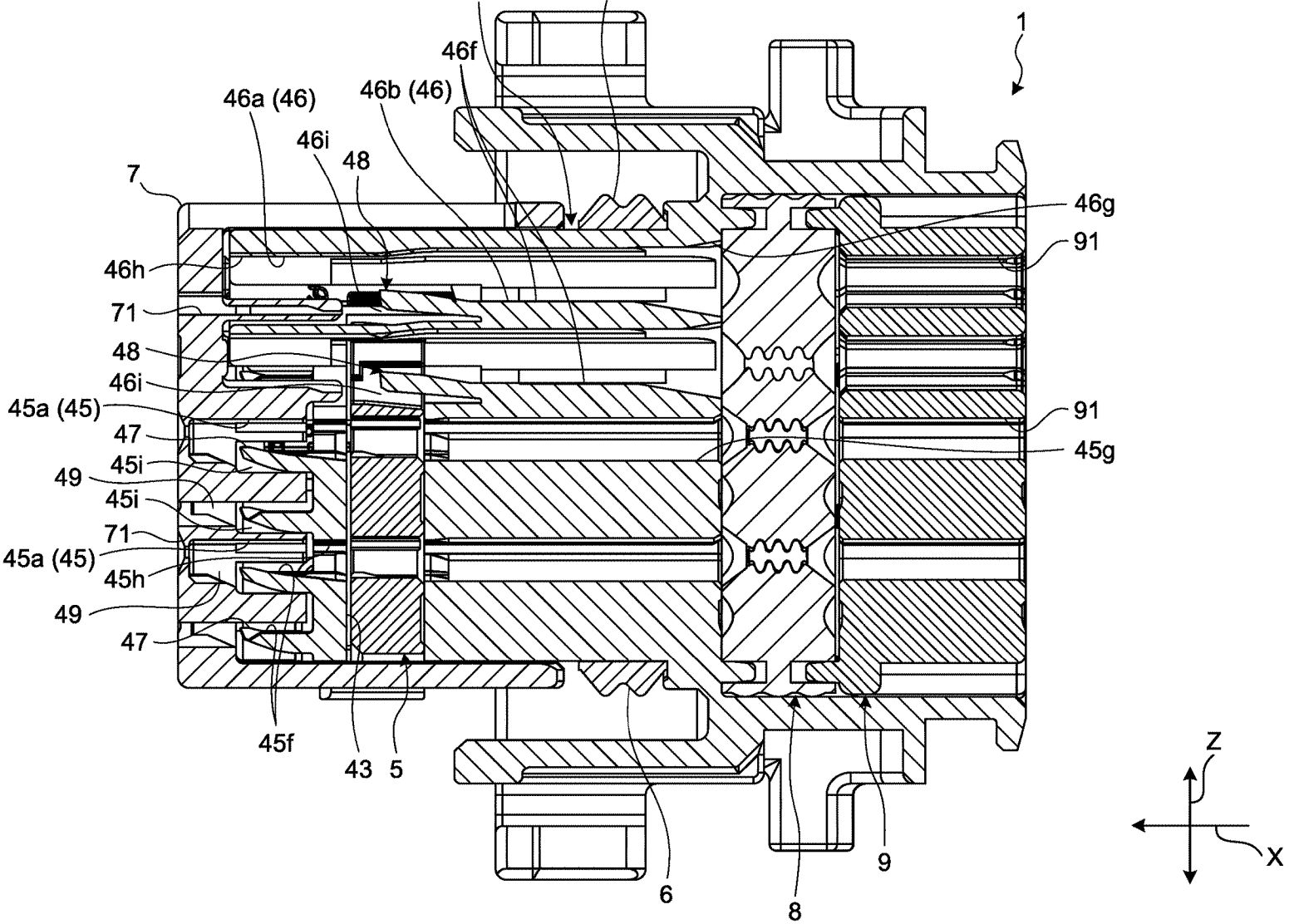
FIG. 7 is a sectional view of a first electrical wire receiving slot and a second electrical wire receiving slot in the housing.
Figure 8:
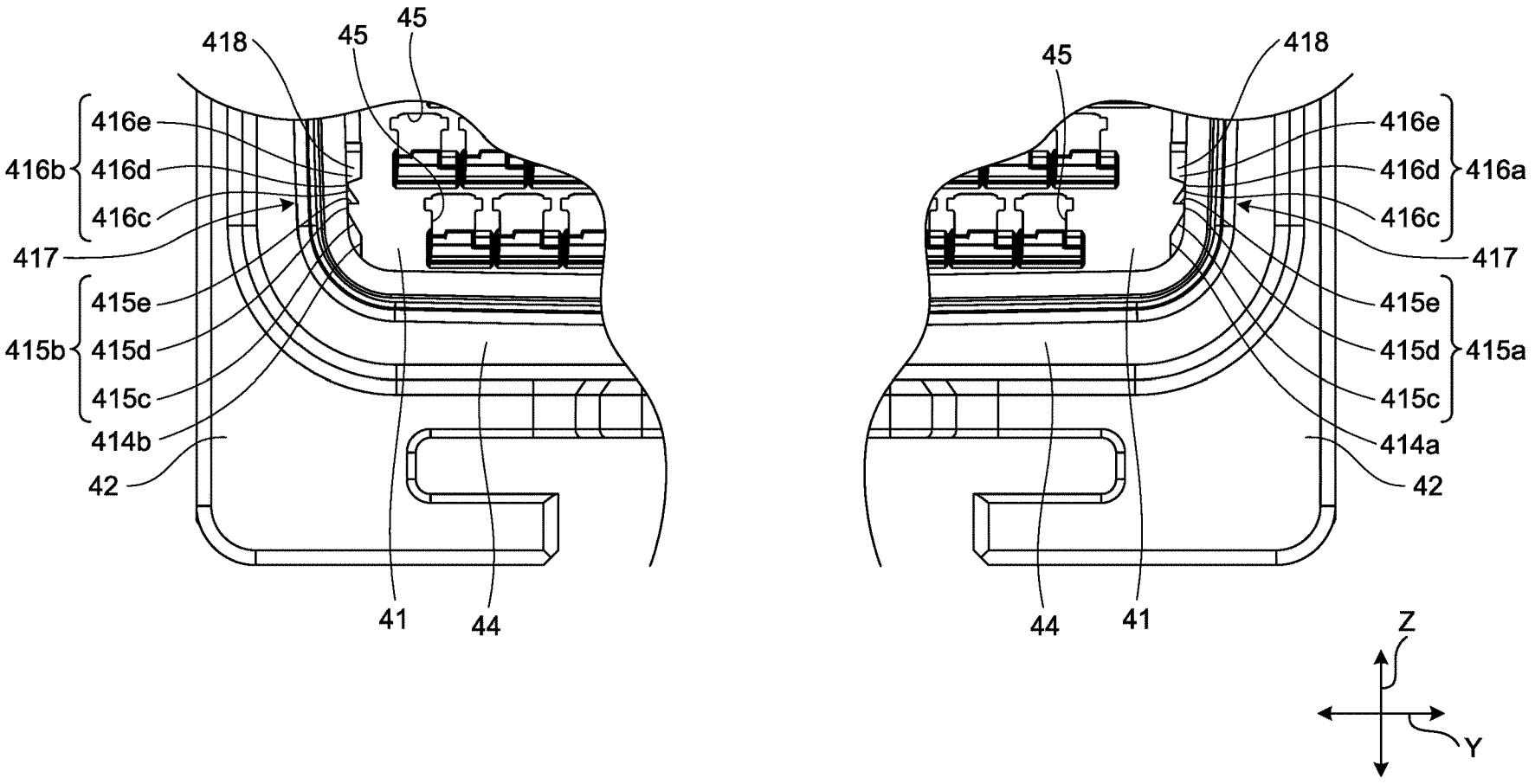
FIG. 8 is a front view illustrating first engagement recesses and second engagement recesses included in the housing.
Figure 9:
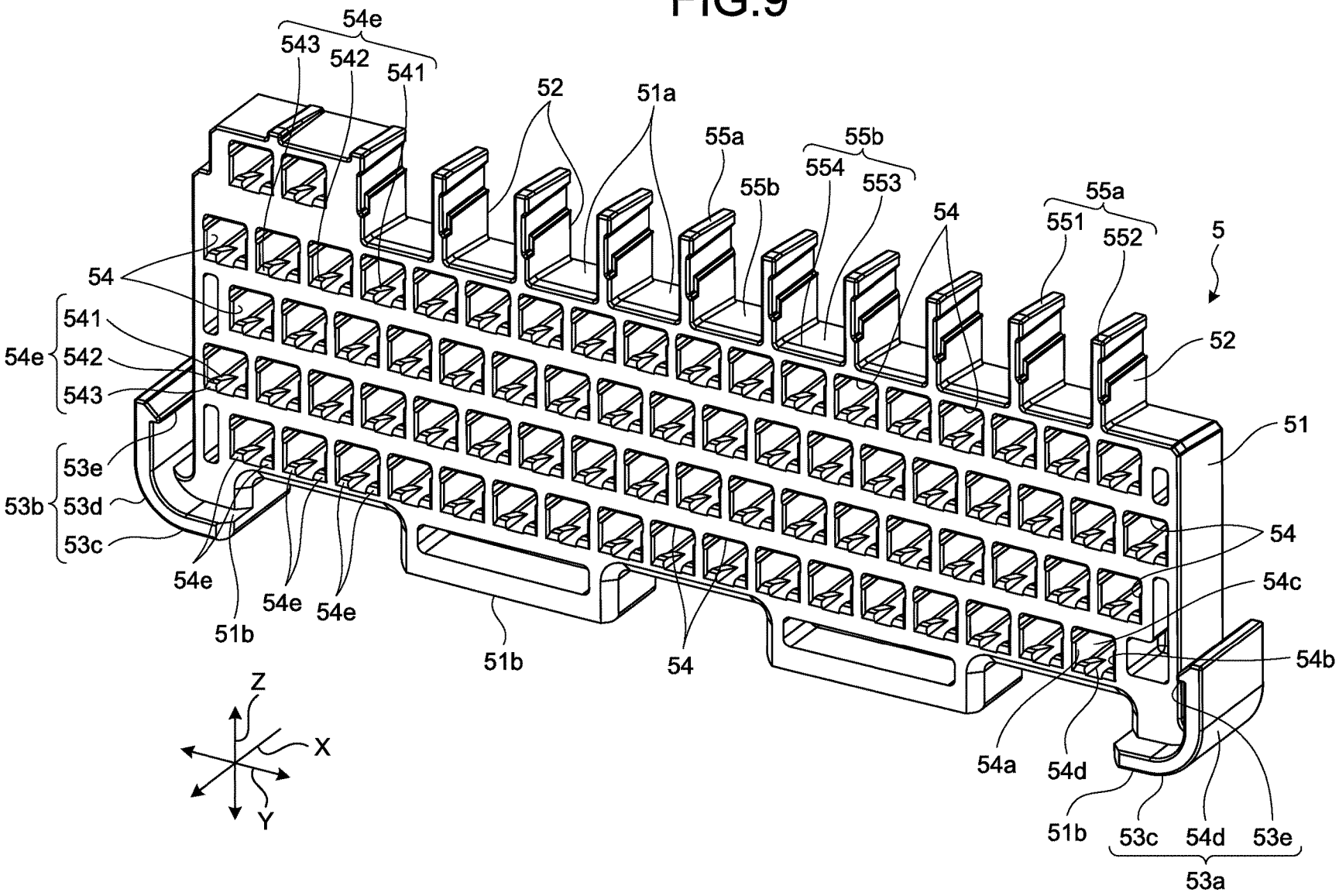
FIG. 9 is a perspective view of a spacer included in the connector.
Figure 10:
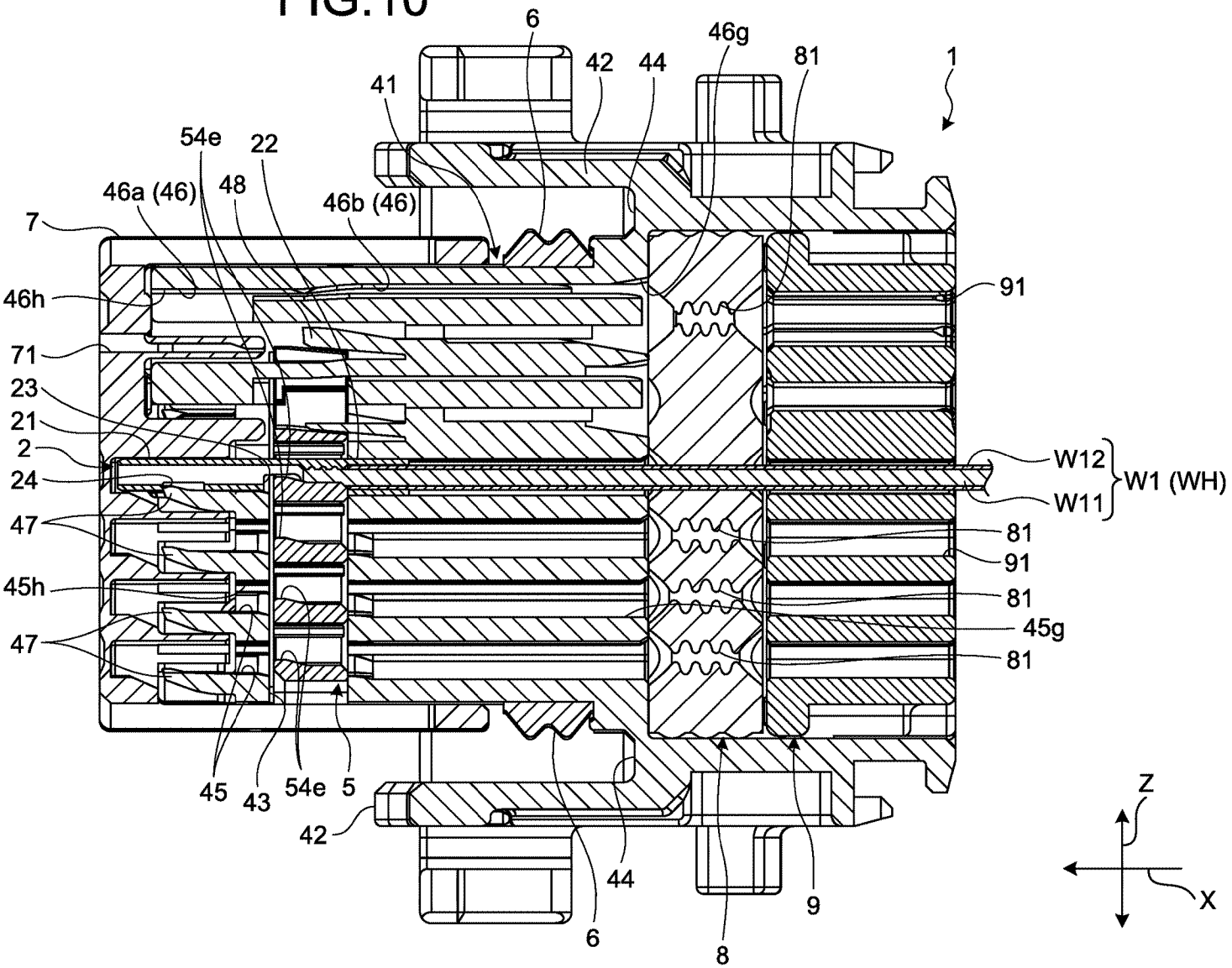
FIG. 10 is a sectional view illustrating a state in which a first terminal has been locked within the first electrical wire receiving slot in the housing.
Figure 11:
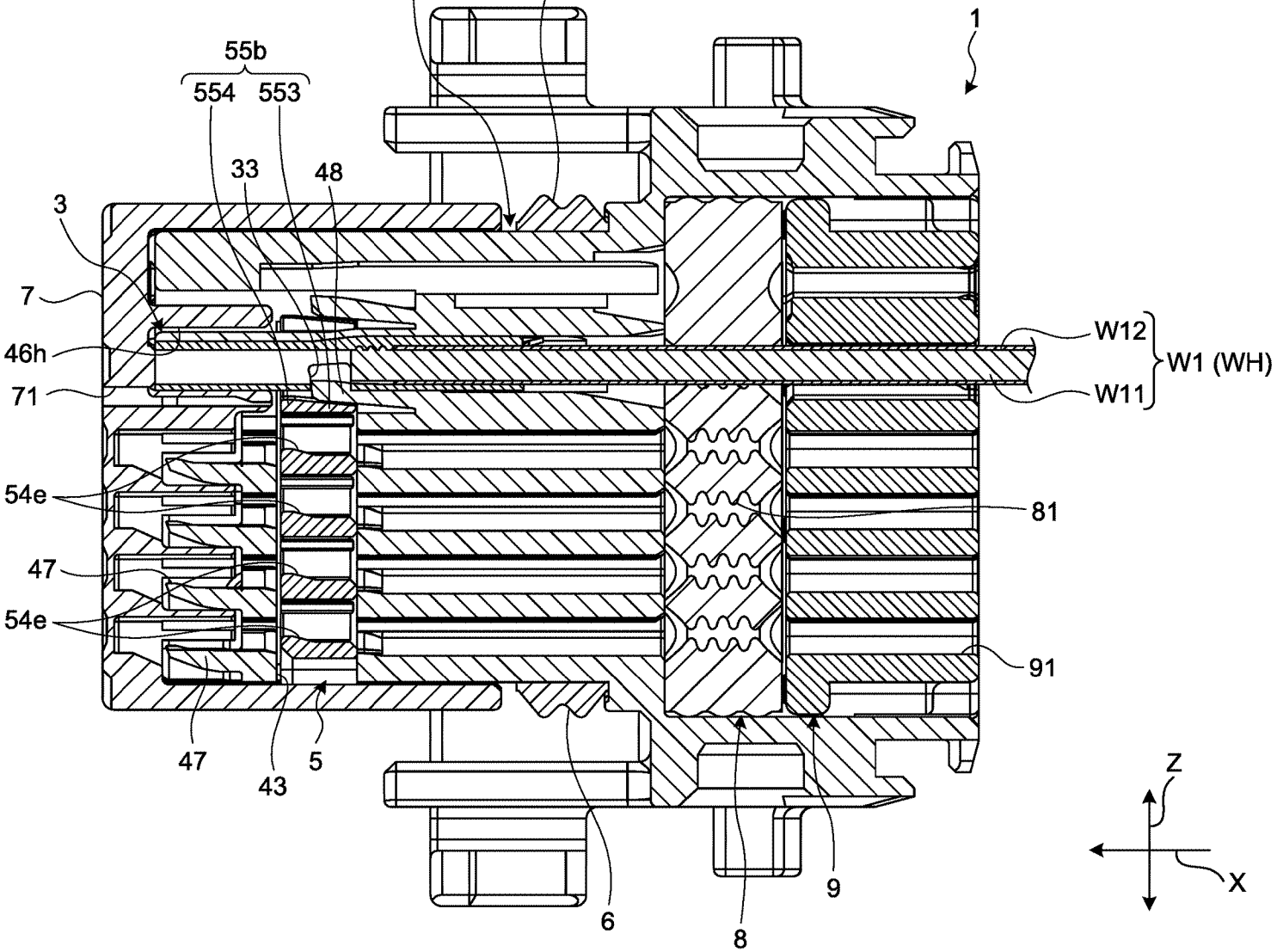
FIG. 11 is a sectional view illustrating a state in which a second terminal has been locked within a lower second electrical wire receiving slot in the housing.
Figure 12:
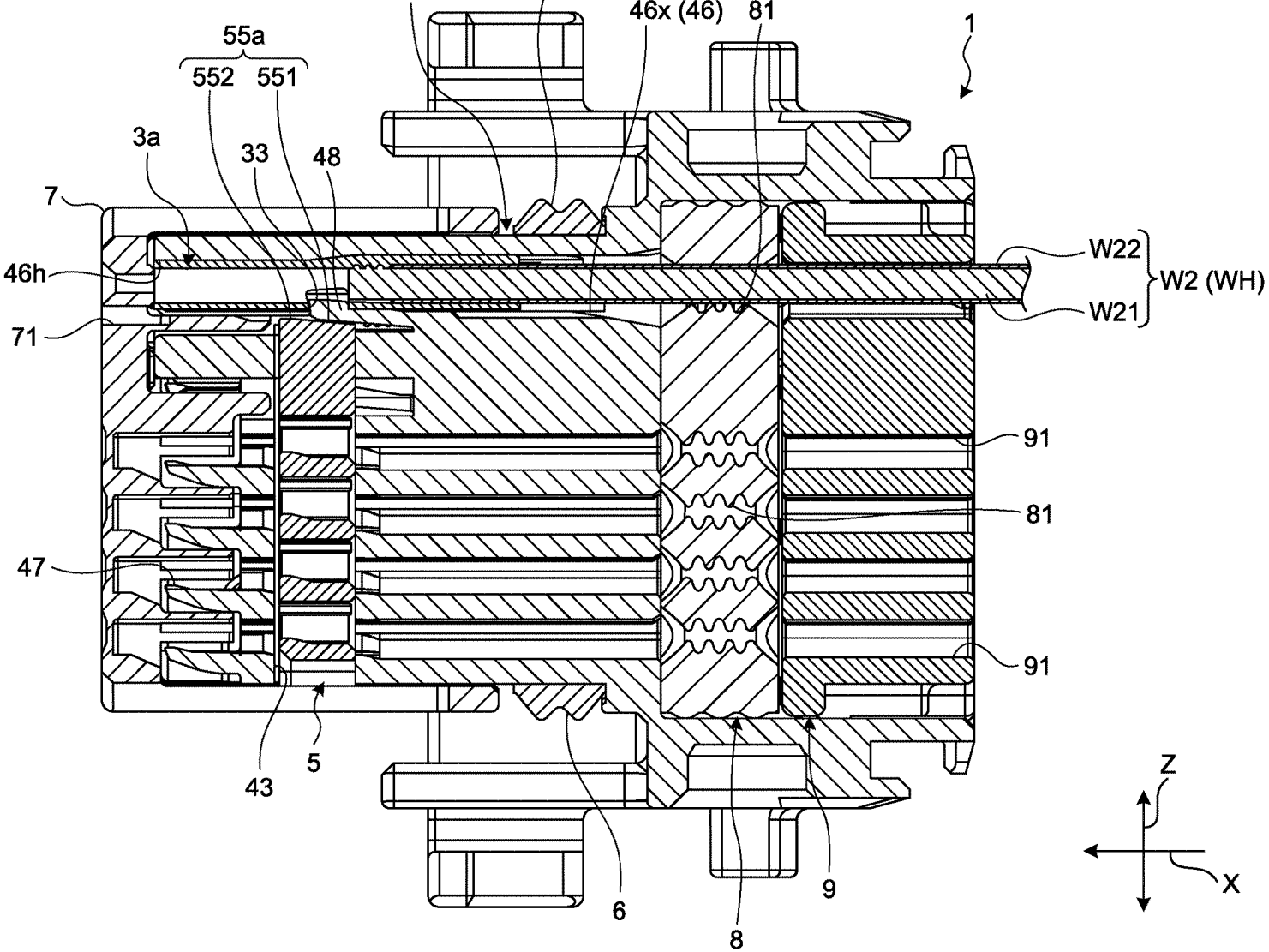
FIG. 12 is a sectional view illustrating a state in which a second terminal has been locked within an upper second electrical wire receiving slot in the housing.
Figure 13:
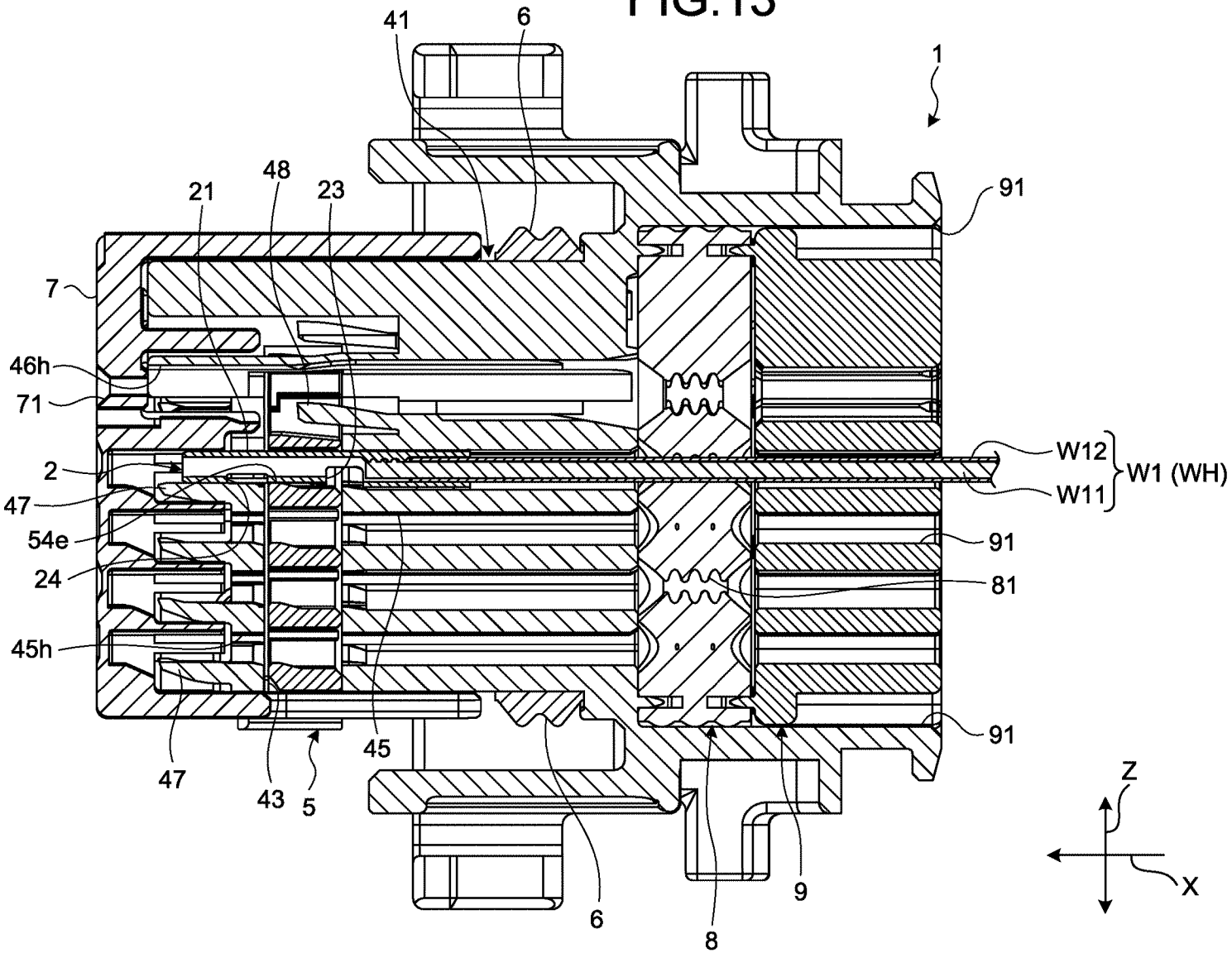
FIG. 13 is a sectional view illustrating a state in which a first terminal inserted into the first electrical wire receiving slot in the housing has not yet reached a proper position thereof.
Figure 14:
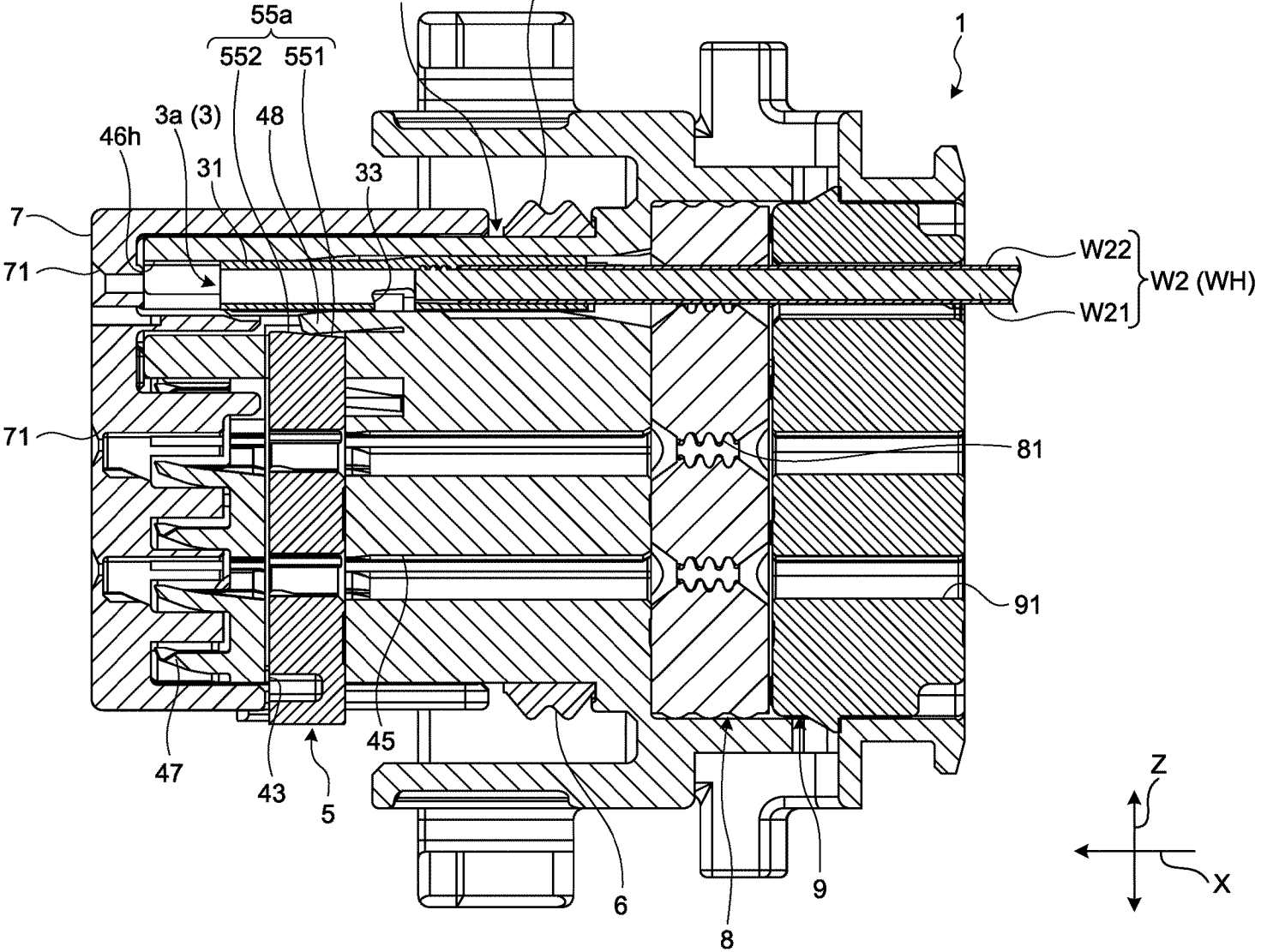
FIG. 14 is a sectional view illustrating a state in which a second terminal inserted into the upper second electrical wire receiving slot in the housing has not yet reached a proper position thereof.

FIG. 1 is a perspective view of a connector according to an embodiment of the present invention. FIG. 2 is an explored perspective view of the connector. FIG. 3 is a perspective view of a first electrical wire included in the connector. FIG. 4 is a perspective view of a second electrical wire included in the connector. FIG. 5 is a partially cutaway perspective view of a housing included in the connector. FIG. 6 is a partially cutaway perspective view of the housing. FIG. 7 is a sectional view of a first electrical wire receiving slot and a second electrical wire receiving slot in the housing. FIG. 8 is a front view illustrating first engagement recesses and second engagement recesses included in the housing. FIG. 9 is a perspective view of a spacer included in the connector. FIG. 10 is a sectional view illustrating a state in which a first terminal has been locked within the first electrical wire receiving slot in the housing. FIG. 11 is a sectional view illustrating a state in which a second terminal has been locked within a lower second electrical wire receiving slot in the housing. FIG. 12 is a sectional view illustrating a state in which a second terminal has been locked within an upper second electrical wire receiving slot in the housing. FIG. 13 is a sectional view illustrating a state in which a first terminal inserted into the first electrical wire receiving slot in the housing has not yet reached a proper position thereof. FIG. 14 is a sectional view illustrating a state in which a second terminal inserted into the upper second electrical wire receiving slot in the housing has not yet reached a proper position thereof.

As illustrated in FIG. 1 to FIG. 3, an X direction is a terminal insertion direction in which terminals of a connector 1 according to the present embodiment are inserted. Y directions are terminal alignment directions Y, in which the terminals of the connector 1 are aligned, perpendicular to the terminal insertion direction. Z directions are upward and downward directions Z (parallel to an assembly direction) of the connector 1 that are perpendicular to the terminal insertion direction X and the terminal alignment directions Y. In the present specification, the terminal insertion direction X may also be referred to as a frontward direction, a direction reverse to the terminal insertion direction X may also be referred to as a rearward direction, and these directions may be collectively referred to as front-rear directions.

The connector 1 is used, for example, for an electronic control unit (ECU) in a vehicle such as an automobile and electrically connects a first electrical wire W1 and a second electrical wire W2 included in a wire harness WH to another electrical wire. The wire harness WH is, for example, an assembly into which a plurality of electrical wires for power supply or communication of signals are bundled together in order that devices installed in a vehicle may be connected to one another, and by which the wires are connected to corresponding devices via a connector or the like. The plurality of electrical wires include the first electrical wire W1 and the second electrical wire W2. The wire harness WH includes the first electrical wire W1 and the second electrical wire W2 that have electrical conductivity, and the connector 1 that is electrically connected to the first electrical wire W1 and the second electrical wire W2. The wire harness WH may further include a grommet, a protector, a sheathing material, and a fixture member.

The connector 1 includes first terminals 2, second terminals 3, a housing 4, a spacer 5, a packing 6, a front mask 7, a mat seal 8, and a mat seal cover 9. The first terminals 2 and the second terminals 3 are female terminals, and the connector 1 is a female connector. By interlocking with a counterpart connector which is a male connector, the connector 1 can connect and electrically conduct the first terminals 2 and the second terminals 3 to counterpart terminals, which are male terminals accommodated in the counterpart connector. The connector 1 constitutes a mechanism for electrically connecting together electrical wires that are coupled to the respective terminals, that is, what is called a connection mechanism for connection between electric wires.

As illustrated in FIG. 3, the first terminal 2 is formed of a material such as an electrically conductive metal in a rectangular cylindrical shape, and is electrically connected to a terminal end of a core wire W11 of the first electrical wire W1 included in the wire harness WH.

The first terminal 2 includes a terminal connection part 21 to which a counterpart terminal (male terminal) in the counterpart connector (male connector) not illustrated is connected, and an electrical connection part 22 to which the terminal end of the core wire W11 of the first electrical wire W1 is connected. The second terminal 3 includes a terminal connection part 31 to which a counterpart terminal (male terminal) in the counterpart connector (male connector) not illustrated is connected, and an electrical connection part 32 to which the terminal end of a core wire W21 of the second electrical wire W2 is connected.

The electrical connection part 22 of the first terminal 2 includes a core-wire crimping part 221 that crimps the core wire W11 of the first electrical wire W1 and a covering crimping part 222 that crimps a covering portion W12 of the first electrical wire W1. The core-wire crimping part 221 is formed in a radially compressed manner, and the dimension of the core-wire crimping part 221 in a radial direction thereof is smaller than the size of the covering crimping part 222 in a radial direction thereof. In the terminal insertion direction X, while the terminal connection part 21 is positioned in the front end side in the terminal insertion direction X of the first terminal 2, the electrical connection part 22 is positioned in the base end side of the first terminal 2.

The first terminal 2 has a first recess 23 positioned between a front end thereof and a base end thereof in the terminal insertion direction X and recessed from a circumferential surface thereof in the front end side. In the first terminal 2 exemplified herein, the first recess 23 is arranged between the terminal connection part 21 and the electrical connection part 22. The first terminal 2 has a third recess 24 positioned at the center of the terminal connection part 21 and recessed from a circumferential surface thereof in the front end side thereof.

As illustrated in FIG. 4, the second terminal 3 is formed of a material such as an electrically conductive metal in a rectangular cylindrical shape, and is electrically connected to a terminal end of the core wire W21 of the second electrical wire W2 included in the wire harness WH.

The electrical connection part 32 of the second terminal 3 includes a core-wire crimping part 321 that crimps the core wire W21 of the second electrical wire W2 and a covering crimping part 322 that crimps a covering portion W22 of the second electrical wire W2. The core-wire crimping part 321 is formed in a radially compressed manner, and the dimension of the core-wire crimping part 321 in a radial direction thereof is smaller than the size of the covering crimping part 322 in a radial direction thereof. In the terminal insertion direction X, while the terminal connection part 31 is positioned in the front end side in the terminal insertion direction X of the second terminal 3, the electrical connection part 32 is positioned in the base end side of the second terminal 3.

The second terminal 3 has a second recess 33 positioned between a front end thereof and a base end thereof in the terminal insertion direction X and recessed from a circumferential surface thereof in the front end side. In the second terminal 3 exemplified herein, the second recess 33 is arranged between the terminal connection part 31 and the electrical connection part 32.

The dimensions of the second terminal 3 in the terminal insertion direction X, in the terminal alignment directions Y, and in the upward and downward directions Z are larger than the dimensions of the first terminal 2 in the terminal insertion direction X, in the terminal alignment directions Y, and in the upward and downward directions Z.

Arrangement in this connector 1 is determined so that the position of the front end of the first terminal 2 and the position of the front end of the second terminal 3 can be different after the first terminal 2 and the second terminal 3 are disposed in proper positions in the terminal insertion direction X (see FIG. 10, FIG. 11, and FIG. 12).

While a plurality of first terminal receiving slots 45 are included in the housing 4, a plurality of such first terminals 2 are provided in the housing 4 and arranged so as for each to correspond to one of the first terminal receiving slots 45. While a plurality of second terminal receiving slots 46 are included in the housing 4, a plurality of such second terminals 3 are provided in the housing 4 and arranged so as for each to correspond to one of the second terminal receiving slots 46. As illustrated in FIG. 2, in the upward and downward directions Z, the second terminals 3 include upper second terminals 3*a* positioned in the upper side and lower second terminals 3*b* positioned in the lower side. The upper second terminals 3*a* are aligned in the terminal alignment directions Y and so are the lower second terminals 3*b*. The lower second terminal 3*b* is arranged between adjacent two of the upper second terminals 3*a* in the terminal alignment directions Y. That is, the upper second terminals 3*a* and the lower second terminals 3*b* are alternately arranged in the terminal alignment directions Y.

The housing 4 is formed of electrically insulating synthetic resin in a certain shape. As illustrated in FIG. 5 and FIG. 6, the housing includes a body part 41, a peripheral edge part 42, an installation space part 43, and an interlocking recess 44. The peripheral edge part 42 is a part positioned around the periphery of the body part 41. The installation space part 43 is a space part formed, in an intermediate portion of the body part 41 in the front-rear directions, along the upward and downward directions Z in such a manner as to extend upward from a lower end portion of the body part 41. The interlocking recess 44 is a part positioned between the body part 41 and the peripheral edge part 42 and recessed rearward and is a part into which an interlocking projection positioned in the front end side of the counterpart connector is inserted.

The body part 41 is formed in a substantially rectangular column-like shape, extends along the terminal insertion direction X as illustrated in FIG. 5 to FIG. 10, and includes the plurality of first terminal receiving slots 45 into which the first terminals 2 are inserted. The body part 41 further includes the plurality of second terminal receiving slots 46 that extend along the terminal insertion direction X and into which the second terminals 3 are inserted. The first terminal receiving slot 45 is formed by wall surfaces 45*c* and 45*d* facing each other in the terminal alignment directions Y and wall surfaces 45*e* and 45*f* facing each other in the upward and downward directions Z. The second terminal receiving slot 46 is formed by wall surfaces 46*c* and 46*d* facing each other in the terminal alignment directions Y and wall surfaces 46*e* and 46*f* facing each other in the upward and downward directions Z. The first terminal receiving slot 45 and the second terminal receiving slot 46 are partitioned by the installation space part 43 in the terminal insertion direction X, thereby having respective front receiving slots 45*a* and 46*a* positioned in the front side and respective rear receiving slots 45*b* and 46*b* positioned in the rear side.

The first terminal receiving slots 45 are arranged side by side in the terminal alignment directions Y, and four of the first terminal receiving slots 45 are arranged side by side in the upward and downward directions Z. When two first terminal receiving slots 45 arranged next to each other in the upward and downward directions Z are arbitrarily selected from the first terminal receiving slots 45, one of the two that is positioned in the lower side is arranged between the first terminal receiving slots 45 each corresponding to the other one of the two that is arranged in the upper side and next to the one in the terminal alignment directions Y. That is, the first terminal receiving slots 45 positioned in the upper side and the first terminal receiving slots 45 positioned in the lower side are alternately arranged in the terminal alignment directions Y.

In the upward and downward directions Z, the second terminal receiving slots 46 include upper second terminal receiving slots 46*x* positioned in the upper side and lower second terminal receiving slots 46*y* positioned in the lower side. The upper second terminal receiving slots 46*x* are aligned in the terminal alignment directions Y and so are the lower second terminal receiving slots 46*y*. The lower second terminal receiving slot 46*y* is arranged between adjacent two of the upper second terminal receiving slots 46*x* in the terminal alignment directions Y. That is, the lower second terminal receiving slots 46*y* and the upper second terminal receiving slots 46*x* are alternately arranged in the terminal alignment directions Y.

A first terminal insertion hole 45*g* for having the first terminal 2 inserted into the inside of the first terminal receiving slot 45 is provided in the rear side of each of the first terminal receiving slots 45. A first terminal tab insertion hole 45*h* for allowing a tab of a male terminal, not illustrated, to enter the inside of the first terminal receiving slot 45 is provided in the front side of each of the first terminal receiving slots 45.

A second terminal insertion hole 46*g* for having the second terminal 3 inserted into the inside of the second terminal receiving slot 46 is provided in the rear side of each of the second terminal receiving slots 46. A second terminal tab insertion hole 46*h* for allowing a tab of a male terminal, not illustrated, to enter the inside of the second terminal receiving slot 46 is provided in the front side of each of the second terminal receiving slots 46.

The body part 41 further includes first lances 47 provided on wall surfaces of the respective first terminal receiving slots 45 and second lances (lances) 48 provided on wall surfaces of the respective second terminal receiving slots 46.

As illustrated in FIG. 7, each of the first lances 47 has a base end part thereof on the lower wall surface 45*f* that forms the front receiving slot 45*a* of the corresponding first terminal receiving slot 45. The first lance 47 extends from the base end part along the terminal insertion direction X and is cantilevered so that a front end thereof can be left as a free end, and the front end is elastically deformable in the upward and downward directions Z with the base end part serving as the pivot point. Before the first terminal receiving slot 45 has the first terminal 2 inserted therein, the first lance 47 is disposed in a lock position in which the first lance 47 has the front end thereof having entered the first terminal receiving slot 45. Inside the first terminal receiving slot 45, a first deformation accommodating space part 45*i* serving as a space part into which the first lance 47 warps is secured on the upper side of the lower wall surface 45*f*. That is, the first deformation accommodating space part 45*i* is disposed between the wall surface 45*f* and the first lance 47.

A front end portion of the first lance 47 is disposed in a space 49 between a front portion of the body part 41, in which the wall surfaces 45*c*, 45*d*, 45*e*, and 45*f* are not present, and the front mask 7. When the first terminal 2 is inserted into the first terminal receiving slot 45, the first terminal 2 makes contact with the first lance 47 as illustrated in FIG. 13. The first lance 47 then is pushed down so as to deform into the first deformation accommodating space part 45*i*, thereby being disposed in a release position retreated from the first terminal receiving slot 45. The first terminal 2 is then caused to go further in the terminal insertion direction X and thereby disposed in a proper position in the first terminal receiving slot 45 after the first terminal 2, whereby the first lance 47 interlocks with the third recess of the first terminal 2 as illustrated in FIG. 10. This prevents the first terminal 2 from escaping from the first terminal receiving slot 45.

As illustrated in FIG. 7, each of the second lances 48 has a base end part thereof on the lower wall surface 46*f* that constitutes the rear receiving slot 46*b* of the corresponding second terminal receiving slot 46. The second lance 48 extends from the base end part along the terminal insertion direction X and is cantilevered so that a front end thereof can be left as a free end, and the front end is elastically deformable in the upward and downward directions Z with the base end part serving as the pivot point. Before the second terminal receiving slot 46 has the second terminal 3 inserted therein, the second lance 48 is disposed in a lock position in which the second lance 48 the front end thereof having entered the second terminal receiving slot 46. Inside the second terminal receiving slot 46, a second deformation accommodating space part 46*i* serving as a space part into which the second lance 48 warps is secured on the upper side of the lower wall surface 46*f*. That is, the second deformation accommodating space part 46*i* is disposed between the wall surface 46*f* and the second lance 48.

A front end portion of the second lance 48 is disposed in the installation space 43 in which the wall surfaces 46*c*, 46*d*, 46*e*, and 46*f* are not present. When the second terminal 3 is inserted into the second terminal receiving slot 46, the second terminal 3 makes contact with the second lance 48 as illustrated in FIG. 14. The second lance 48 then is pushed down so as to deform toward the second deformation accommodating space part 46*i*, thereby being disposed in a release position retreated from the second terminal receiving slot 46. The second terminal 3 is then caused to go further in the terminal insertion direction X, thereby being disposed in a proper position in the second terminal receiving slot 46 as illustrated in FIG. 11.

There are a pair of first projections 415*a* and 415*b* formed on respective wall parts 414*a* and 414*b* on opposite two sides of an outside circumferential surface of the body part 41 in the terminal alignment directions Y and a pair of second projections 416*a* and 416*b* formed on the respective wall parts 414*a* and 414*b* as illustrated in FIG. 8. The first projections 415*a* and 415*b* project in different directions in which the first projections 415*a* and 415*b* draw farther away from each other, and so do the second projections 416*a* and 416*b*.

Each of the first projections 415*a* and 415*b* positioned lower has a first sloping part 415*c* provided as a sloping surface, a first top part 415*d* provided as a vertical surface, and a first horizontal part 415*e* provided as a horizontal surface. The pair of first sloping parts 415*c* slope upward from the upper ends of corresponding parts on the lower side thereof in such a manner as to draw farther away from each other.

Each of the second projections 416*a* and 416*b* positioned higher has a second sloping part 416*c* provided as a sloping surface, a second top part 416*d* provided as a vertical surface, and a third horizontal part 416*e* provided as a sloping surface. The pair of second sloping parts 416*c* slope upward from the upper ends of the corresponding first horizontal parts 415*e* of the first projections 415*a* and 415*b* in directions in which the second sloping parts 416*c* draw farther away from each other. The pair of third sloping parts 416*e* slope upward from the upper ends of the corresponding second top parts 416*d* so as to draw nearer to each other.

The outside circumferential surface of the body part 41 has a pair of first engagement recesses 417 formed by the corresponding first horizontal parts 415*e* and the corresponding second sloping parts 416*c* and also has a pair of second engagement recesses 418 formed by the third sloping parts 416*e*.

As illustrated in FIG. 9, the spacer 5 is formed of electrically insulating synthetic resin in a certain shape, and has a base part 51, plate-like parts 52 and a pair of arm parts 53*a* and 53*b*. The base part 51 is a part formed in a rectangular parallelepiped shape. The plate-like parts 52 are formed so as to project upward from an upper end 51*a* of the base part 51. The pair of arm parts 53*a* and 53*b* are provided on a lower end 51*b* of the base part 51. The spacer 5 is disposed in the installation space part 43 of the housing 4 by being moved upward from the lower side after the spacer 5 is disposed under the housing 4.

The base part 51 is formed so as to correspond to the first terminal receiving slots 45 and includes coupling slots 54 that couple together the front receiving slots 45*a* and the rear receiving slots 45*b* of the respective first terminal receiving slots 45. The coupling slot 54 is formed by wall surfaces 54*a* and 54*b* facing each other in the terminal alignment directions Y and wall surfaces 54*c* and 54*d* facing each other in the upward and downward directions Z.

The lower wall surface 54*d* of each of the coupling slots 54 have lock parts 54*e* provided on both sides thereof that project upward from the wall surface 54*d*. Each of the lock parts 54*e* has a sloping surface 541 sloping upward from the rear side toward the front side, a top part 542 provided as a horizontal surface extending frontward from the upper end of the sloping surface 541, and a sloping surface 543 sloping downward from the front end of the top part 542 toward the front side.

As illustrated in FIG. 9, the respective plate-like parts 52 are provided so as to correspond to the upper second terminal receiving slots 46*x*, and respective first regulation parts 55*a* are provided on the upper end of the plate-like parts 52. The first regulation part 55*a* has a sloping surface 551 sloping upward from the rear side toward the front side and a top part 552 provided as a horizontal surface extending frontward from the upper end of the sloping surface 551.

As illustrated in FIG. 9, respective second regulation parts 55*b* are provided on the upper end 51*a* of the base part 51 of the spacer 5 so as to correspond to the respective lower second terminal receiving slots 46*y*. The second regulation part 55*b* is arranged between adjacent two of the plate-like parts 52 in the terminal alignment directions Y. The second regulation part 55*b* has a sloping surface 553 sloping upward from the rear side toward the front side and a top part 554 provided as a horizontal surface extending frontward from the upper end of the sloping surface 553.

Each of the arm parts 53*a* and 53*b* of the body part 41 has a first portion 53*c*, a second portion 53*d*, and an engagement claw portion 53*e* and is formed so as to be elastically deformable. The first portions 53*c* project downward from opposite two side portions of the lower end 51*b* of the base part 51. The second portions 53*d* project, from end portions of the corresponding first portions 53*c* in the terminal alignment directions Y, in such a manner as to draw farther away from each other and also project upward in such a manner as to trace arcs. The engagement claw portions 53*e* project from the upper ends of the corresponding second portions 53*d* in such a manner as to draw nearer to each other. Each of the engagement claw portions 53*e* in a pair is capable of engaging with any one of the corresponding first engagement recess 417 and the corresponding second engagement recess 418 of the housing.

The packing 6 is formed of, for example, an elastic material such as synthetic resin and is arranged on the outside circumferential surface of the body part 41 of the housing 4 as illustrated in FIG. 2. The packing 6 is provided to prevent a foreign substance such as water from entering the first and the second terminal receiving slots 45 and 46 through the first terminal tab insertion holes 45*h* and the second terminal tab insertion holes 46*h* when the connector 1 and the counterpart connector have interlocked with each other.

The front mask 7 is, for example, formed of a material such as electrically insulating synthetic resin in a certain shape and is provided to hold the packing 6 between itself and the body part 41 of the housing 4 in the front-rear directions as illustrated in FIG. 2 and FIG. 10. In the front mask 7, mask insertion holes 71 that lead to the respective first terminal tab insertion holes 45*h* of the first terminal receiving slot 45 and the respective second terminal tab insertion holes 46*h* of the second terminal receiving slots 46 in the front-rear directions (see FIG. 7).

The mat seal 8 is, for example, formed of an elastic material such as electrically insulating synthetic resin and is arranged in the rear of the body part 41 of the housing 4 as illustrated in FIG. 2 and FIG. 10. The mat seal 8 is provided to prevent a foreign substance such as water from entering the first terminal receiving slots 45 and the second terminal receiving slots 46 through the first terminal insertion holes 45*g* and the second terminal insertion holes 46*g*. In the front-rear directions, the mat seal 8 has electrical wire passage holes 81 through each of which any one of the first electrical wire W1 and the second electrical wire W2 passes to be brought out of the first and the second terminal receiving slots 45 and 46. The electrical wire passage holes 81 are formed so as to correspond to the first and the second terminal insertion holes 45*g* and 46*g* of the first and the second terminal receiving slots 45 and 46.

The mat seal cover 9 is formed of a material such as electrically insulating synthetic resin in a certain shape and is provided to hold the mat seal 8 between itself and a rear end portion of the housing 4 in the front-rear directions as illustrated in FIG. 2 and FIG. 10. In the front-rear directions, the mat seal cover 9 has electrical wire passage holes 91 through each of which any one of the first electrical wire W1 and the second electrical wire W2 passes to be brought out of the first and the second terminal receiving slots 45 and 46. The electrical wire passage holes 91 are formed so as to correspond to the first and the second terminal insertion holes 45*g* and 46*g* of the first and the second terminal receiving slots 45 and 46.

In assembly of the connector 1, for example, the spacer 5 is moved upward after being disposed under the housing 4, and the upper end 51*a* of the spacer 5 is inserted into the installation space part 43 of the housing 4, as illustrated in FIG. 2. Thereafter, the spacer 5 is moved further upward until reaching a receiving slot coupling position in which the spacer 5 has the engagement claw portions 53*e* engaging with the pair of first engagement recesses 417 of the body part 41. As a result of this movement, the coupling slots 54 of the spacer 5 couple the front receiving slots 45*a* and 46*a* to the rear receiving slots 45*b* and 46*b*. Thus, the first terminal receiving slots 45 extending along the terminal insertion direction X and the second terminal receiving slot 46 extending along the terminal insertion direction X are formed at the same time inside the housing 4.

Thereafter, the packing 6 and the front mask 7 are attached to the front part of the body part 41, and the first terminals 2 and the second terminals 3 are inserted through the first and the second terminal insertion holes 45*g* and 46*g* from the rear side of the body part until reaching respective proper positions thereof in the first and the second terminal receiving slots 45 and 46.

Thereafter, the spacer 5 is moved further upward from the receiving slot coupling position, whereby, after the pair of engagement claw portions 53*e* of the spacer 5 are moved so as to go farther apart from each other, the engagement claw portions 53*e* then go over the second projections 416*a* of the body part 41. Consequently, each of the second engagement recesses 418 of the body part 41 and the corresponding engagement claw portion 53*e* of the spacer 5 engage with each other, and the spacer 5 is disposed in a normal position, which is the highest possible position thereof.

When the spacer 5 is disposed in the normal position as illustrated in FIG. 10 with the first terminal 2 inserted into the proper position thereof in the first terminal receiving slot 45, the corresponding lock part 54*e* of the spacer 5 interlocks with the first recess 23 of the first terminal 2, whereby the first terminal 2 is locked in the first terminal receiving slot 45. Thus, the first terminal 2 is prevented from escaping from the first terminal receiving slot 45 (see FIG. 10). In addition, the first lance 47 interlocks with the third recess 24 of the first terminal 2. Consequently, the first terminal 2 is prevented from escaping from the first terminal receiving slot 45 by this double interlocking with the first terminal 2.

During assembly, in case the first terminal 2 has not reached the proper position thereof and is positioned halfway thereto because of sufficient insertion of the first terminal 2 into the first terminal receiving slot 45, the corresponding lock part 54*e* makes contact with the terminal connection part 21 of the first terminal 2 as illustrated in FIG. 13. Thus, the first recess 23 of the first terminal 2 and the first lance 47 cannot interlock with each other, and the spacer 5 therefore cannot be disposed in the normal position. A part of the spacer 5 consequently projects from the outside circumferential surface of the housing 4, which makes it easy to understand that the first terminal 2 has not been inserted into the first terminal receiving slot 45 well enough to reach the proper position thereof.

When the spacer 5 is disposed in the normal position as illustrated in FIG. 11 with the lower second terminal 3*b* inserted into the proper position thereof in the lower second terminal receiving slot 46*y*, the second regulation part 55*b* makes contact from below with the second lances 48, which is in the lock position. Thus, the second lance 48 is prevented from deforming toward the release position thereof. When the second lance 48 is disposed in the lock position, the second lance 48 interlocks with the second recess 33 of the lower second terminal 3*b* that has been inserted into the proper position thereof in the lower second terminal receiving slot 46*y*. As a result, the lower second terminal 3*b* is locked in the lower second terminal receiving slot 46*y*, whereby the lower second terminal 3*b* is prevented from escaping from the lower second terminal receiving slot 46*y*.

When the spacer 5 is disposed in the normal position as illustrated in FIG. 12 with the upper second terminal 3*a* inserted into the proper position thereof in the upper second terminal receiving slot 46*x*, the first regulation part 55*a* makes contact from below with the second lance 48, which is in the lock position. Thus, the second lance 48 is prevented from deforming toward the release position. When the second lance 48 is disposed in the lock position, the second lance 48 interlocks with the second recess 33 of the upper second terminal 3*a* that has been inserted into the proper position thereof in the upper second terminal receiving slot 46*x*. As a result, the upper second terminal 3*a* is locked in the upper second terminal receiving slot 46*x*, whereby the upper second terminal 3*a* is prevented from escaping from the upper second terminal receiving slot 46*x*.

During assembly, in case the second terminal 3 has not reached the proper position thereof and is positioned halfway thereto because of insufficient insertion of the upper second terminal 3*a* into the upper second terminal receiving slot 46*x*, the corresponding second lance 48 makes contact with the upper second terminal 3*a* as illustrated in FIG. 14. Thus, the second lance 48 deforms toward the second deformation accommodating space part 46*i*, and the second lance 48 is pushed downward, thereby being disposed in the release position retreated from the upper second terminal receiving slot 46*x*. In this condition, the second recess 33 of the upper second terminal 3*a* and the second lance 48 cannot interlock with each other, and the corresponding first regulation part 55*a* makes contact with the second lance 48 of the spacer 5, whereby the spacer 5 cannot be disposed in the normal position. A part of the spacer 5 consequently projects from the outside circumferential surface of the housing 4, which makes it easy to understand that the upper second terminal 3*a* has not been inserted into the upper second terminal receiving slot 46*x* so sufficiently as to reach the proper position thereof. The same applies to the lower second terminal 3*b* that is inserted to the lower second terminal receiving slot 46*y* although illustrations thereof are omitted.

The spacer 5 included in the connector 1 according to the present embodiment has the following configurations. The spacer 5 includes the lock parts 54*e* each configured to lock the first terminal 2 in the first terminal receiving slot 45 after the first terminal 2 has been inserted into the proper position thereof in the first terminal receiving slot 45. The spacer 5 further includes the first regulation parts 55*a* and the second regulation parts 55*b* that prevent the second lances 48 from deforming toward the respective release positions thereof while the second lances 48 are in the lock positions in which the second lances 48 lock, in the second terminal receiving slots 46, the second terminals 3 that have been inserted into the respective proper positions in the second terminal receiving slots 46. Consequently, the terminals 2 and 3 of various types can be appropriately retained using the single spacer 5, and the internal space of the housing 4 can be effectively utilized. Not only that, the second terminals 3 are locked in the second terminal receiving slots 46 via the second lances 48. Therefore, even when the spacer 5 is rapidly moved upward, the elastically deformable second lances 48 function as bumpers, thus being capable of preventing large force from acting on the second terminals 3. The spacer 5 is built into the installation space part 43 of the housing 4 from the upward and downward directions Z perpendicular to the terminal insertion direction X, the contact areas between the second lances 48 and the spacer 5 can be larger than otherwise. As a result, less force acts on a unit area of the second lances 48.

In addition, when the spacer 5 is moved into the installation space part 43 with the first terminal 2 inserted into the proper position thereof, the first recess 23 and the corresponding lock part 54*e* interlock with each other, and the spacer 5 is disposed in the normal position. In contrast, when the spacer 5 is moved into the installation space part 43 without the first terminal 2 inserted so sufficiently as to reach the proper position thereof, the first recess 23 and the corresponding lock part 54*e* do not interlock with each other, and the spacer 5 is disposed in a position deviated from the normal position. A part of the spacer 5 consequently projects from the outside circumferential surface of the housing 4, which makes it easy to understand that the first terminal 2 has not been inserted into the first terminal receiving slot 45 so sufficiently as to reach the proper position thereof.

Furthermore, when the spacer 5 is moved into the installation space part 43 with the second terminal 3 inserted into the proper position thereof, the second recess 33 and the second lance 48 interlock with each other, and the spacer 5 is disposed in the normal position. In contrast, when the spacer 5 is moved into the installation space part 43 without the second terminal 3 inserted so sufficiently as to reach the proper position thereof, a corresponding one of the first regulation part 55*a* and the second regulation part 55*b* makes contact with the second lance 48 then present in the release position. Therefore, the second recess 33 and the corresponding one of the first regulation part 55*a* and the second regulation part 55*b* do not interlock with each other, and the spacer 5 is disposed in a position deviated from the normal position. A part of the spacer 5 consequently projects from the outside circumferential surface of the housing 4, which makes it easy to understand that the second terminal 3 has not been inserted into the second terminal receiving slot 46 so sufficiently as to reach the proper position thereof.

In addition, each of the lower second terminals 3*b* is arranged between adjacent two of the upper second terminals 3*a* in the terminal alignment directions Y. In the spacer 5, the first regulation parts 55*a* configured to regulate deformation of the second lances 48 that lock the upper second terminals 3*a* in the second terminal receiving slots 46 and the second regulation parts 55*b* configured to regulate deformation of the second lances 48 that lock the lower second terminals 3*b* in the second terminal receiving slots 46 are alternately arranged along the terminal alignment directions Y. Therefore, a large number of such second terminals 3 can be disposed within the limited internal space of the housing 4.

The front ends of the first lances 47 are arranged in the space 49 located in front of the body part 41 of the housing 4. This configuration eliminates the need to separately provide a space inside the housing 4 for accommodating deformation of the first lances 47, whereby the internal space of the housing 4 can be effectively utilized.

Furthermore, the front ends of the second lances 48 are arranged in the installation space 43 in which the spacer 5 is to be arranged. This configuration eliminates the need to separately provide a space inside the housing 4 for accommodating deformation of the second lances 48, whereby the internal space of the housing 4 can be effectively utilized.

The first terminal 2 has the first recess 23 and the third recess 24. When the first terminal 2 is disposed in the proper position thereof, the first recess 23 and the corresponding lock part 54*e* of the spacer 5 interlock with each other, and so do the third recess 24 and the corresponding first lance 47 of the housing 4. This configuration prevents the first terminal 2 from escaping from the first terminal receiving slot 45. Not only that, the third recess 24 interlocks with the first lance 47 located in front of the installation space part 43 in which the spacer 5 is to be arranged. This configuration prevents the first terminal 2 from moving rearward even when force of a large magnitude acts on a front portion of the first terminal 2 for connecting together a male terminal and a female terminal.

In the above-described embodiment, a female connector including female terminals as the first terminals 2 and the second terminal 3 is described as the connector 1. However, the present invention is not limited thereto, and is also applicable to a male connector including male terminals as the first terminals and the second terminals.

In the above-described embodiment, the connector 1 including the first terminal 2 and the second terminal 3 is described. The second terminal 3 has larger dimensions in the terminal insertion direction X, in the terminal alignment directions Y, and in the upward and downward directions Z than the first terminal 2. However, the present invention is not limited thereto and is also applicable to the connector 1 that includes the second terminal that has a larger dimension than the first terminal only in the terminal insertion direction X.

A spacer included in a connector according to the present embodiment has the following configurations. The spacer includes a lock part that locks, in a first terminal receiving slot, a first terminal that has been inserted into a proper position in the first terminal receiving slot. The spacer also includes a regulation part that regulates deformation of a lance toward a release position when the lance is in a lock position in which the lance locks, in the corresponding second terminal receiving slot, a second terminal that has been inserted into a proper position in the second terminal receiving slot. These configurations enable the connector to appropriately retain terminals of various types using the single spacer.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector comprising:

a first terminal;

a second terminal different from the first terminal;

a housing that includes a first terminal receiving slot extending along a terminal insertion direction and configured to have the first terminal inserted therein, a second terminal receiving slot extending along the terminal insertion direction and configured to have the second terminal inserted therein, a lance provided on a wall surface of the second terminal receiving slot and being elastically deformable between a lock position and a release position, the lock position being a position in which the lance locks the second terminal in the second terminal receiving slot after the second terminal enters the second terminal receiving slot and is inserted into a proper position, the release position being a position retreated from the second terminal receiving slot, and an installation space part formed along an assembly direction intersecting the terminal insertion direction; and a spacer configured to be incorporated, during assembly, into the installation space part by being moved in the assembly direction, wherein the spacer includes a lock part configured to lock the first terminal in the first terminal receiving slot after the first terminal is inserted into a proper position in the first terminal receiving slot, and a regulation part configured to make contact from below with the lance and to prevent the lance from deforming toward the release position when the lance is located in the lock position in which the lance locks the second terminal in the second terminal receiving slot after the second terminal is inserted into a proper position in the second terminal receiving slot.

2. The connector according to claim 1, wherein the first terminal has a first recess located between a front end portion thereof and a base end portion thereof in the terminal insertion direction and recessed from a circumferential surface of the front end portion, the lock part of the spacer is capable of interlocking with the first recess, when the spacer is moved to the installation space part with the first terminal inserted into the proper position, the first recess and the lock part interlock with each other, and the spacer is disposed in a normal position, and when the spacer is moved to the installation space part with the first terminal not inserted into the proper position, the first recess and the lock part do not interlock with each other, and the spacer is disposed in a position deviated from the normal position.

3. The connector according to claim 1, wherein the second terminal has a recess located between a front end portion thereof and a base end portion thereof in the terminal insertion direction and recessed from a circumferential surface of the front end portion, the lance is capable of interlocking with the recess, when the spacer is moved to the installation space part with the second terminal inserted into the proper position, the recess and the lance interlock with each other, and the spacer is disposed in a normal position, and when the spacer is moved to the installation space part with the second terminal not inserted into the proper position, the recess and the lance do not interlock with each other, and the spacer is disposed in a position deviated from the normal position.

4. The connector according to claim 2, wherein the second terminal has a second recess located between a front end portion thereof and a base end portion thereof in the terminal insertion direction and recessed from a circumferential surface of the front end portion, the lance is capable of interlocking with the second recess, when the spacer is moved to the installation space part with the second terminal inserted into the proper position, the second recess and the lance interlock with each other, and the spacer is disposed in a normal position, and when the spacer is moved to the installation space part with the second terminal not inserted into the proper position, the second recess and the lance do not interlock with each other, and the spacer is disposed in a position deviated from the normal position.

5. The connector according to claim 3, wherein the second terminal includes upper second terminals positioned in an upper part in the assembly direction and lower second terminals positioned in a lower part in the assembly direction, the upper second terminals and the lower second terminals are aligned in a terminal alignment direction intersecting the terminal insertion direction and the assembly direction, each of the lower second terminals is arranged between adjacent two of the upper second terminals in the terminal alignment direction, the regulation part includes first regulation parts and second regulation parts, the first regulation parts being configured to prevent of the lance that locks one of the upper second terminals in the second terminal receiving slot from deforming, the second regulation parts being configured to prevent of the lance that locks one of the lower second terminals in the second terminal receiving slot from deforming, and the first regulation parts and the second regulation parts are alternately arranged in the terminal alignment direction.

6. The connector according to claim 4, wherein the second terminal includes upper second terminals positioned in an upper part in the assembly direction and lower second terminals positioned in a lower part in the assembly direction, the upper second terminals and the lower second terminals are aligned in a terminal alignment direction intersecting the terminal insertion direction and the assembly direction, each of the lower second terminals is arranged between adjacent two of the upper second terminals in the terminal alignment direction, the regulation part includes first regulation parts and second regulation parts, the first regulation parts being configured to prevent of the lance that locks one of the upper second terminals in the second terminal receiving slot from deforming, the second regulation parts being configured to prevent of the lance that locks one of the lower second terminals in the second terminal receiving slot from deforming, and the first regulation parts and the second regulation parts are alternately arranged in the terminal alignment direction.

* * * * *